United States Patent [19]

Ohminato

[11] Patent Number: 4,624,595

[45] Date of Patent: Nov. 25, 1986

[54] RING TYPE BINDER

[75] Inventor: Kiyoshi Ohminato, Tokyo, Japan

[73] Assignee: King Jim Co., Ltd., Japan

[21] Appl. No.: 629,436

[22] Filed: Jul. 10, 1984

[30] Foreign Application Priority Data

Feb. 7, 1984 [JP] Japan ..... 59-15668[U]

[51] Int. Cl.[4] ..... B42F 3/04; B42F 13/20

[52] U.S. Cl. ..... 402/34; 402/31

[58] Field of Search ..... 402/31, 34, 36, 37, 402/39, 46

[56] References Cited

U.S. PATENT DOCUMENTS

| | | | |
|---|---|---|---|
| 416,036 | 11/1889 | Lash | 402/34 |
| 1,299,276 | 4/1919 | Whitlock | 402/34 |
| 1,797,447 | 3/1931 | Savidge | 402/34 |
| 3,333,592 | 8/1967 | Huffaker | 402/34 |

FOREIGN PATENT DOCUMENTS

| | | | |
|---|---|---|---|
| 360649 | 10/1922 | Fed. Rep. of Germany | 402/34 |
| 1034002 | 7/1953 | France | 402/34 |

*Primary Examiner*—Paul A. Bell
*Assistant Examiner*—Paul M. Heyrana, Sr.
*Attorney, Agent, or Firm*—Wegner & Bretschneider

[57] ABSTRACT

A four ring-type binder including turnable and fixed rods, in which turnable rods comprise two turnable ring rods each being formed by bending a single metal wire member, one turnable ring rod including two ring sectors opposite to one fixed ring rod and the other turnable ring rod including similar two ring sectors, and in which, among the four ring sectors, only the ring sectors located at the central portion of a binder body have at their free ends stoppers engageable with the free ends of the associated fixed ring rods.

4 Claims, 6 Drawing Figures

RING TYPE BINDER

BACKGROUND OF THE INVENTION

The present invention relates to a ring type binder and, more especially, to such a binder of the type that four sets of rings are formed upon closing.

Usually, the ring type binder includes turnable rods and fixed rods arranged in opposite relation thereto, which form together rings upon closing. Especially for a large-sized file, a ring type binder in which four rings are formed is used.

SUMMARY OF THE INVENTION

A main object of the present invention is to provide a four ring-type binder of the type which can be closed or opened by giving a touch thereto.

According to the present invention, this object is achieved by the provision of a four ring-type binder including turnable and fixed rods, characterized in that said turnable rods comprise two pair of turnable ring rods each being formed by bending a single metal wire member, one turnable ring rod including two ring sectors opposite to one fixed rod and the other pair of turnable ring rod including similar two ring sectors, and in that, among the four ring sectors, only the ring sectors located at the central porton of a binder body have at their free ends stoppers engageable with the free ends of the associated fixed rods.

BRIEF DESCRIPTION OF THE DRAWINGS

The above-mentioned and other objects and features of the present invention will become apparent from a reading of the following detailed description with reference to the accompanying drawings, which are given for the purpose of illustration alone, and in which.

DETAILED DESCRIPTION OF THE INVENTION

Figures 1, 2:
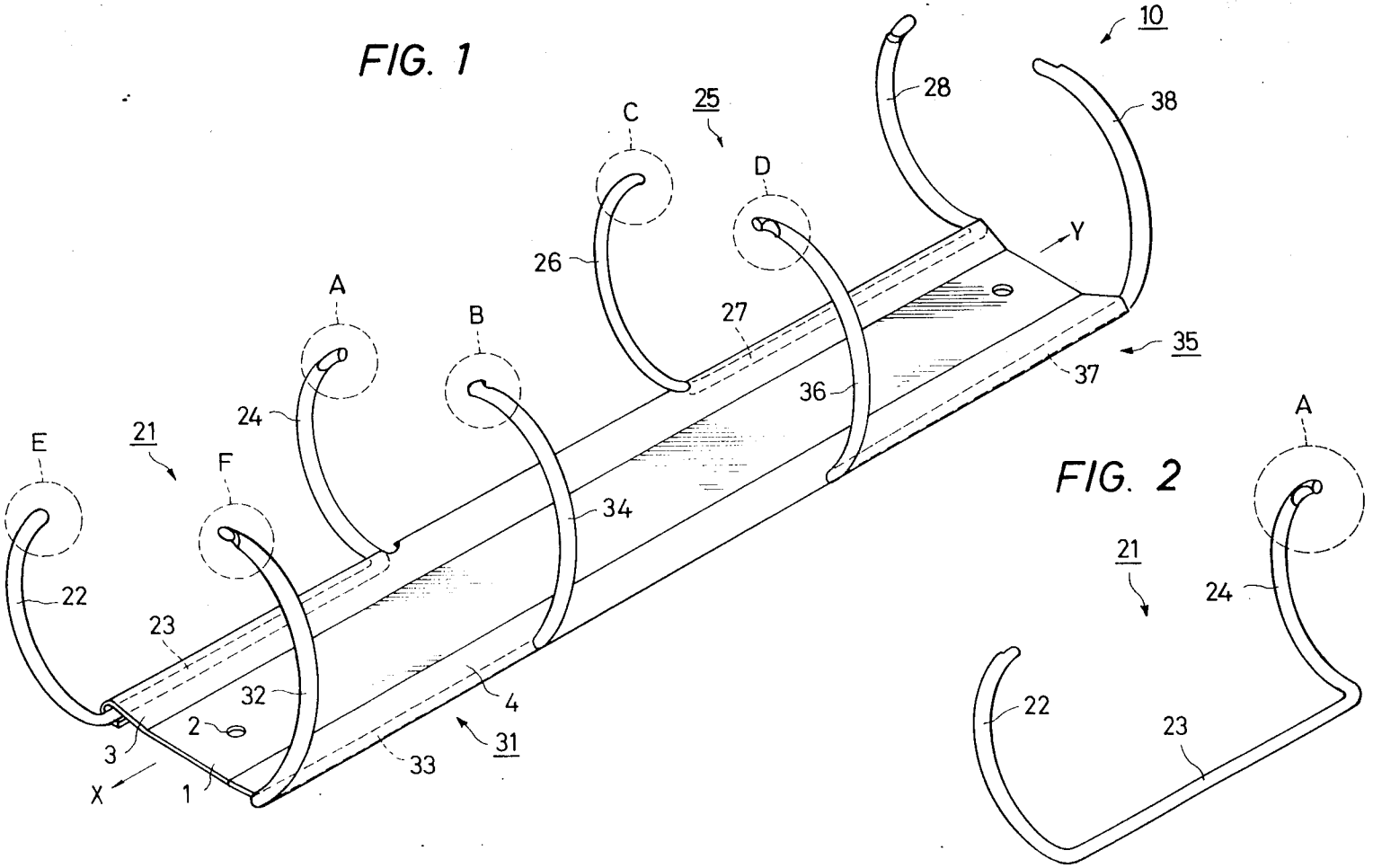
FIG. 1 is a perspective view showing one embodiment of the ring type binder according to the present invention.
FIG. 2 is a view showing one turnable ring rod.

Referring to FIG. 1, a bottom plate 1 is fixed to the backbone of a file, and provided therein with rivet holes 2 for its fixation. The bottom plate 1 is provided on one side with a rounded portion 3 for holding a turnable ring rod, and on the other side with a rounded portion 4 for fixing a fixed rod.

The turnable rods comprise turnable ring rods 21 and 25. As shown in FIG. 2, the turnable ring rod 21 is formed by bending a single metal wire, and includes ring sectors 22, 24 and a retainer portion 23. As shown by a dotted line in FIG. 1, the retainer portion 23 is rotatably held in the rounded portion 3 of the bottom plate 1. Likewise, the turnable ring rod 25 is formed by bending a single metal wire, and includes ring sectors 26, 28 and a retainer portion 27 which is rotatably held in the rounded portion 3. The opposite fixed rods comprise fixed ring rods 31 and 35. The fixed ring rod 31 includes ring sectors 32, 34 and a caulking portion 33, while the fixed ring rod 35 includes ring sectors 36, 38 and a caulking portion 37. The fixed ring rods 31 and 35 are fixed at the caulking portions 33 and 37 in the rounded portions 4 of the bottom plate 1 by caulking. In this arrangement, the ring sectors 22, 24, 26 and 28 of the turnable rods are opposite to the ring sectors 32, 34, 36 and 38 of the fixed rods.

According to the present invention, among the four sets of ring sectors, engagement is made only between the free ends (indicated by dotted line circles A and C) of the middle ring sectors 24 and 46 and the free ends (indicated by dotted line circles B and D) of the opposite ring sectors 34 and 36.

Figure 3:
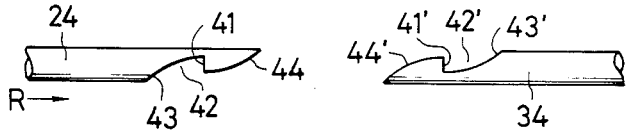
FIGS. 3–5 inclusive are views showing the turnable ring sectors opposite to the accociated fixed ring sectors.

Referring to FIG. 3, there are shown the circle portions A and B (the free ends of the ring sectors 24 and 34) on an enlarged scale and as viewed from above in FIG. 1. As illustrated, the free end of the ring sector 24 includes a pawl portion 41 with a curved front face 44, a dent portion 42 and a tapered portion 43, while the free end of the fixed ring sector 34 includes a pawl portion 41' with a curved front face 44', a dent portion 42' and a tapered portion 43'.

As the turnable rod moves toward the fixed rod in the direction as shown by an arrow R, the curved faces 44 and 44' come first into contact with each other, and the pawl portions 41 and 41' then bite into the associated dent portion 42' and 42, so that the ring sector 24 engages the ring sector 34.

Figure 4:
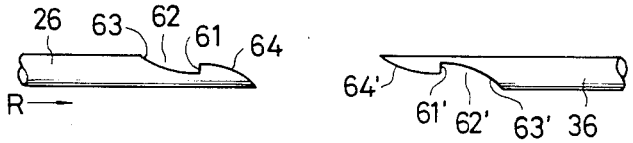

Referring to FIG. 4, there are also shown the circle portions C and D (the free ends of the ring sectors 26 and 36) on an enlarged scale and as viewed from above in FIG. 1. The structure of FIG. 4 is similar to that of FIG. 3, provided that the positions of the pawls are reversed. The free end of the ring sector 26 includes a pawl portion 61 with a curved front face 64, a dent portion 62 and a tapered portion 63, while the free end of the ring sector 36 includes a pawl portion 61' with a curved front face 64', a dent portion 62' and a tapered portion 63'.

As the ring sector 26 moves toward the ring sector 36 in the direction indicated by an arrow R, the pawls 61 and 61' bite into the associated dent portion 62' and 62, so that the ring sector 26 engages the ring sector 36. As evident from the drawing, the pawl portion 41 of the ring sector 24 faces in the direction of X of the bottom plate 1, while the pawl portion 61 of the ring sector 26 faces in the direction Y of the bottom plate 1.

Figure 5:
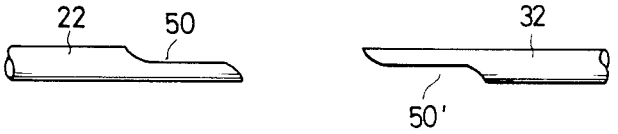

Referring to FIG. 5, there are shown the free end of the outermost ring sector 22 (the circle E in FIG. 1) and the free end of the ring sector 32 (the circle F) at an enlarged scale. The free end of the ring sector 22 is cut out at 50, while the free end of the ring sector 32 is cut out at 50'. When the turnable ring rod 21 engages the fixed ring rod 31, the cut-out 50 is in coincidence with the cut-out 50'. Likewise, the free ends of the ring sectors 28 and 38 are cut out.

According to the arrangement as described above, giving only a touch to the ring sectors 24 and 26 causes the turnable rods to turn toward the fixed rods, so that the turnable ring rods 21 and 25 turn. As a result, the ring sectors 22, 24, 26 and 28 all reach the opposite ring sectors 32, 34, 36 and 38, so that the free ends of the ring sectors 22 and 28 engage the free ends of the ring sectors 34 and 36, the free ends of the ring sectors 22 and 28 are in coincidence with the free ends of the ring sectors 32 and 38 whereby four sets of rings are formed.

In order to open the binder, only a touch is given to the ring sectors 24 and 26, so that the pawl portions 41 and 60 disengage the associated dent portion 41' and 61' with turning of the ring rods 21 and 25. Thus, the four rings are opened.

Figure 6:
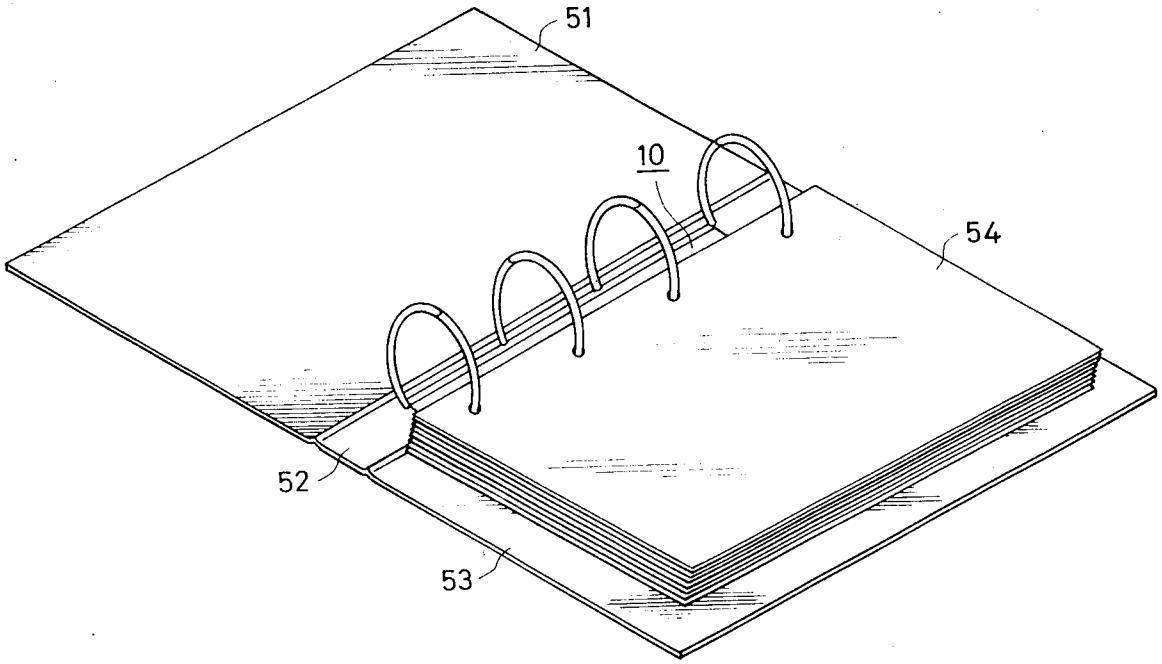
FIG. 6 is a view showing the inventive binder in an opened state.

FIG. 6 illustrates the binder of the present invention, which is attached to a file. Reference numerals 51, 52, 53 and 54 stand for the cover, backbone and backcover of a file and documents kept therein, respectively. Reference numeral 10 indicates the inventive binder attached to the backbone.

Although four sets of rings are formed, the ring type binder of the present invention is of extremely high practicality, since it is opened or closed by giving only a touch to the central two ring sectors without separately manipulating the four turnable ring rods.

While the present invention has been described with reference to the preferred embodiments, it is to be understood that many changes or modifications may be made without departing from the spirit and scope as defined in the appended claims.

What is claimed is:

1. A ring-type binder comprising a bottom plate; a pair of fixed ring rods, each fixed ring rod comprising two fixed ring sectors jointed by a base portion and fixed to said bottom plate; and a pair of turnable ring rods, each turnable ring rod comprising two turnable ring sectors joined by a base portion and rotatably mounted on said bottom plate; said ring rods being mounted such that said fixed ring sectors and said turnable ring sectors together mate to form a pair of inner rings and a pair of outer rings, wherein only said ring sectors forming said inner rings have stopper means at the mating ends thereof for selective engagement and disengagement with each other without the use of additional opening or closing means.

2. A ring-type binder as defined in claim 1, wherein said stopper means comprises an idented portion comprising a concavely curved front face and a shoulder forming a pawl, and a convexly curved front face at the mating end of each inner ring sector, said concave face of each inner ring sector mating with the convex face of each mating ring sector and the shoulder of each inner ring sector mating with the shoulder of the ring sector mating therewith, whereby pushing each pair of mating shoulders out of engagement will disengage said stopper means.

3. A ring-type binder as defined in claim 2, wherein the front faces of the inner turnable ring sectors face away from each other and the front faces of the inner fixed ring sectors face toward each other.

4. A ring-type binder as defined in claim 1, wherein the ends of the outer ring sectors are narrowed to freely mate with each other.

* * * * *